US009440664B2

(12) United States Patent
Liu et al.

(10) Patent No.: US 9,440,664 B2
(45) Date of Patent: Sep. 13, 2016

(54) COMPACT BUFFER HAVING OVERLOAD PROTECTION

(71) Applicant: QINGDAO SRI TECHNOLOGY CO., LTD., Qingdao (CN)

(72) Inventors: Hui Liu, Qingdao (CN); Kai Chen, Qingdao (CN); Jiang He, Qingdao (CN)

(73) Assignee: QINGDAI SRI TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 14/495,763

(22) Filed: Sep. 24, 2014

(65) Prior Publication Data

US 2015/0008208 A1 Jan. 8, 2015

Related U.S. Application Data

(63) Continuation of application No. PCT/CN2012/083341, filed on Oct. 23, 2012.

(30) Foreign Application Priority Data

Apr. 17, 2012 (CN) ..... 2012 1 0111073

(51) Int. Cl.

*B61G 11/00* (2006.01)
*B61G 7/14* (2006.01)
*B61G 7/10* (2006.01)
(Continued)

(52) U.S. Cl.

CPC ..... *B61G 11/00* (2013.01); *B61G 7/10* (2013.01); *B61G 7/14* (2013.01); *B61G 9/06* (2013.01); *B61G 11/16* (2013.01)

(58) Field of Classification Search

CPC ..... B61G 11/00; B61G 11/16; B61G 7/10; B61G 7/14; B61G 9/06

See application file for complete search history.

(56) References Cited

U.S. PATENT DOCUMENTS

| | | | | |
|---|---|---|---|---|
| 5,312,007 | A | 5/1994 | Kaufhold et al. | 213/75 R |
| 8,783,479 | B2 * | 7/2014 | Ewerding | B61G 7/00 213/221 |
| 2007/0107623 | A1 * | 5/2007 | Radewagen | B61G 7/10 105/50 |

(Continued)

FOREIGN PATENT DOCUMENTS

| | | |
|---|---|---|
| CN | 1976840 A | 6/2007 |
| CN | 201573671 U | 9/2010 |

(Continued)

OTHER PUBLICATIONS

International Search Report of corresponding International PCT Application No. PCT/CN2012/083341, dated Jan. 24, 2013.

(Continued)

*Primary Examiner* — Jason C Smith
(74) *Attorney, Agent, or Firm* — J.C. Patents

(57) ABSTRACT

A compact buffer having overload protection, comprising a buffer connected to a coupling, a mount (1) connected to a vehicle body, and a rotating shaft (2) connecting the buffer to the mount (1); the buffer comprises an elastic element (4), a buffer housing (3) accommodating the elastic element (4), and a protective cover (5) for bearing impact force located at the tail end of the buffer housing (3); the buffer housing (3) and the protective cover (5) are connected by means of an overload protection device (6). Use of the method which involves breaking the connection between a buffer housing and an elastic element enables the integration of an overload protection device and a coupling buffer.

5 Claims, 5 Drawing Sheets

(51) Int. Cl.
*B61G 9/06* (2006.01)
*B61G 11/16* (2006.01)

(56) References Cited

U.S. PATENT DOCUMENTS

| | | | | |
|---|---|---|---|---|
| 2011/0162555 | A1 | 7/2011 | Hayashi | 105/392.5 |
| 2011/0253663 | A1* | 10/2011 | Liu | B61G 9/06 213/75 R |
| 2012/0031299 | A1* | 2/2012 | Kontetzki | B60R 19/34 105/392.5 |
| 2014/0360962 | A1* | 12/2014 | Lv | B61G 7/08 213/43 |
| 2015/0008208 | A1* | 1/2015 | Liu | B61G 7/14 213/221 |
| 2015/0069002 | A1* | 3/2015 | Stroud | B61G 7/10 213/7 |
| 2015/0114921 | A1* | 4/2015 | Chen | B61G 9/22 213/155 |

FOREIGN PATENT DOCUMENTS

| | | | |
|---|---|---|---|
| CN | 101698415 | B | 6/2011 |
| CN | 102343918 | A | 2/2012 |
| CN | 202541572 | U | 11/2012 |
| DE | 196 36 225 | A1 | 3/1998 |
| DE | 101 53 460 | A1 | 5/2003 |
| WO | WO 2007/057072 | A1 | 5/2007 |

OTHER PUBLICATIONS

Chinese First Examination Report of corresponding China Application No. 201210111073.9, dated Mar. 24, 2014.

Chinese Notice of Allowance of corresponding China Application No. 201210111073.9, dated Aug. 5, 2014.

Russian Federation Decision of Grant of corresponding Russia patent application No. 2014145825/11(073918), dated Feb. 15, 2016.

* cited by examiner

COMPACT BUFFER HAVING OVERLOAD PROTECTION

CROSS-REFERENCE TO RELATED APPLICATIONS

This application is a continuation of International Application No. PCT/CN2012/083341 filed on Oct. 23, 2012, entitled COMPACT BUFFER HAVING OVERLOAD PROTECTION, which claims the priority benefit of Chinese Patent Application No. 201210111073.9, filed on Apr. 17, 2012. The entirety of the above-mentioned patent applications are hereby incorporated by reference herein and made a part of this specification.

FIELD OF THE INVENTION

The invention relates to a railway vehicle buffer device, in particular to a buffer device having overload protection, comprising a buffer connected to a coupling, a mount connected to a vehicle body, and an internal compressible elastic element.

BACKGROUND OF THE INVENTION

As one of basic components of a railway vehicle, the coupling buffer has the advantages of rapidly connecting and disconnecting railway vehicles, transmitting vehicle tractive force, and improving vehicle safety and comfortability.

The coupling buffer essentially comprises a coupling device, a squashing device, a buffer device, and an overload protection device. The coupling device has the function of connecting and disconnecting railway vehicles; the squashing device has the function of protecting vehicle body and passenger safety in emergency; as a coupling buffer, the buffer device has the function of improving the longitudinal impulse performance and improving vehicle safety and comfortability; when railway vehicles suffer from great longitudinal impact, the overload protection device facilitates the coupling buffer to separate from vehicles, and further facilitates other energy absorbing devices on vehicles to come into play. As an important energy absorbing device in the coupling buffer, the buffer mainly takes part in longitudinal energy absorption in the normal running process of railway vehicles. Many existing buffers realize the function of energy absorption by means of compressing internal elastic components, while a buffer itself is connected to the mounting seat by means of a rotation axle so as to realize the function of rotation of the coupling buffer. The mounting seat is connected to vehicle body by means of an erection bolt or the overload protection device so as to transmit longitudinal load.

At present, commonly the overload protection device is arranged on the outside of the coupling buffer, directly connecting the coupling buffer with vehicle body, and facilitates the coupling buffer to separate from the vehicle body once it comes into play. An existing railway vehicle coupling buffer mainly consists of a fixed-type housing (the mount), a compressible elastic element and a shell bearing the elastic element. For realization of overload protection inside the buffer, one method is to break the connection between the mount and the shell, and the other method is to break the connection between the shell and the elastic element. At present, the first method is widely used; but this method requires for small size of the shell and inside components, and requires the shell to break out of a hole at the rear of the mount of the coupling buffer successfully. However, the mount is limited by design of the vehicle body, and it is difficult to enlarge the hole size. A high-performance buffer usually has a large volume, and is unable to break out of the mount successfully. Hence, the application scope of the first method for realization of overload protection is greatly restricted. For integrating the overload protection device, the existing high-performance buffer shall ensure the number of components breaking out of the mount is reduced; the existing mode cannot be used for ensuring all components inside break out of the mount, instead, a few components breaking out of the mount can achieve the objective of overload protection.

DISCLOSURE OF THE INVENTION

Technical Problems

In allusion to defects of the prior art, the invention aims at providing an integration of the buffer with overload protection by ensuing a few components breaking out of the mount, without damaging a revolving pair between the buffer and the mount; in allusion to existing high-performance buffers for railway vehicles, a method breaking the connection between the buffer housing and the elastic element is used for realizing integration of the overload protection device and the coupling buffer.

Technical Solution

The technical scheme of the invention is as below: a compact buffer having overload protection, comprising a buffer connected to a coupling, a mount connected to a vehicle body, and a rotating shaft connecting the buffer to the mount; wherein the buffer comprises an elastic element, a buffer housing accommodating the elastic element, and a protective cover for bearing impact force located at the tail end of the buffer housing; the buffer housing and the protective cover are connected by means of an overload protection device.

The overload protection device connecting the buffer housing and the protective cover is a component of preset damage load.

The front end of the buffer housing is provided with a caging device.

The caging device is a stop nut.

The elastic element is provided with a tensile and compressive converter plate matched with the caging device.

Beneficial Effect

The beneficial effects of the invention is as below: in allusion to existing high-performance buffers for existing railway vehicles, the invention realizes an integration of the overload protection device and the coupling buffer by adopting a method breaking the connection between the buffer housing and the elastic element.

1. The invention realizes integration of a large-volume high-performance buffer and the overload protection device, freeing this kind of buffer from connecting with a vehicle body by means of an adapter plate, thus greatly reducing the weight.

2. The structural design of the vehicle body is more simple due to nonuse of the adapter plate.

3. As this kind of buffer usually is of a cylindrical structure, once the overload protection device comes into play, the motion of the coupling breaking out of the mount is controlled by the buffer housing. Hence it is better than existing products in terms of stability and reliability.

4. The overload protection device is installed inside the coupling buffer, not requiring for installation together with the adapter plate any more. Therefore the modularity of the product is better.

5. The number of components breaking out of the mount is less after the overload protection device is broken, the volume of the overload protection device is reduced, and the opening on the installation surface of the coupling of a railway vehicle is correspondingly reduced, which is conducive to improving the vehicle body strength.

6. Most of overload protection devices in the prior art adopt a shear load for generating a destruction mode. Compared with tensile property, metallic materials are less stable in terms of shear behavior. Therefore, overload protection devices in shear are more demanding for materials of components and heat treatment, etc. However, overload protection devices adopting a tensile failure mode are more simple for manufacturing and processing, which is conducive to reducing manufacturing cost.

EMBODIMENTS OF THE INVENTION

Figure 1:
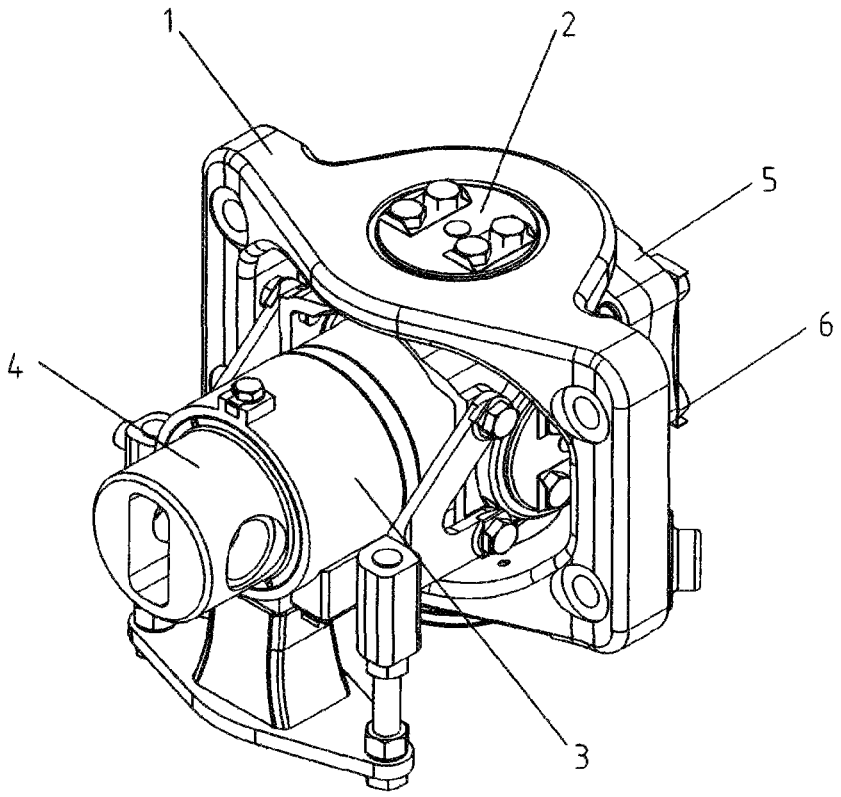
FIG. 1 and FIG. 2 are structure diagrams of the invention.
Figure 2:
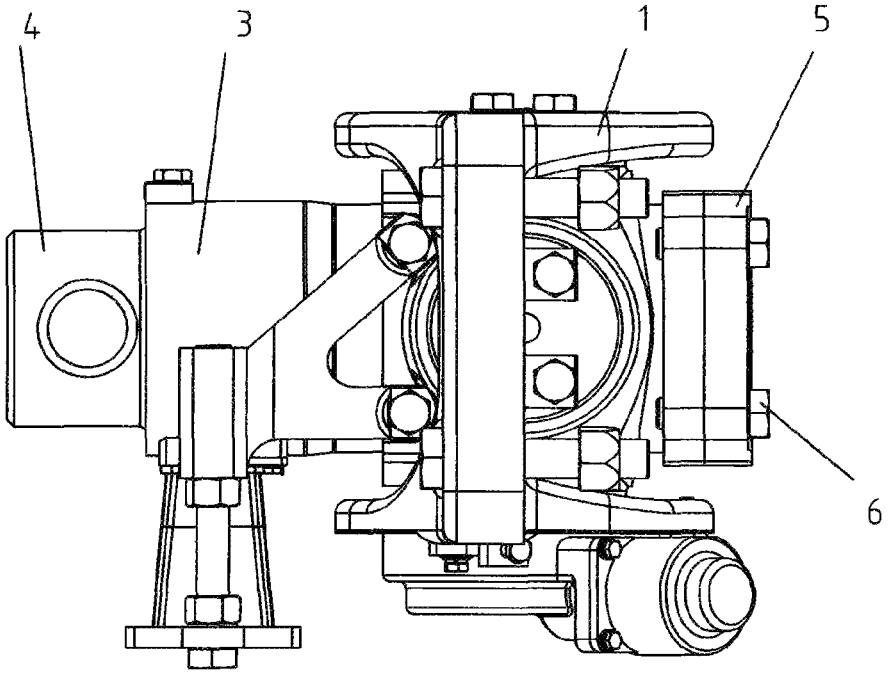
Figure 3:
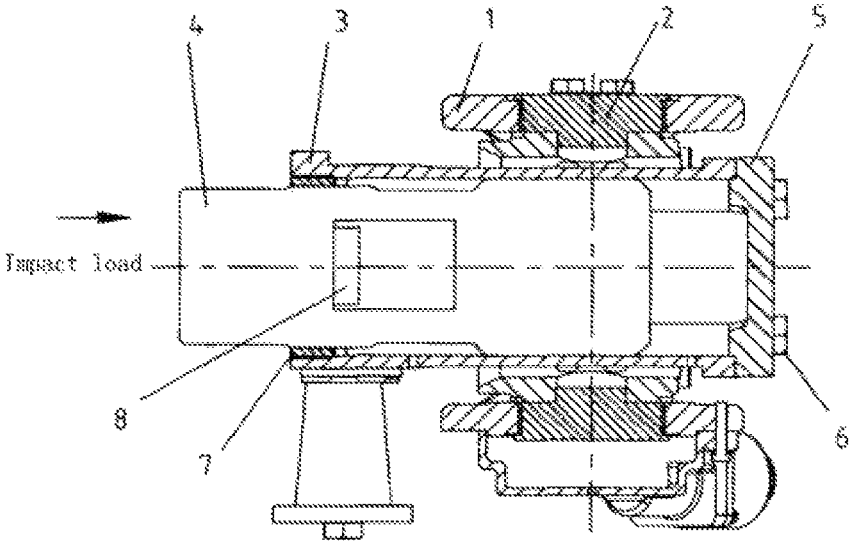
FIG. 3 is a section view of the invention.
Figure 4:
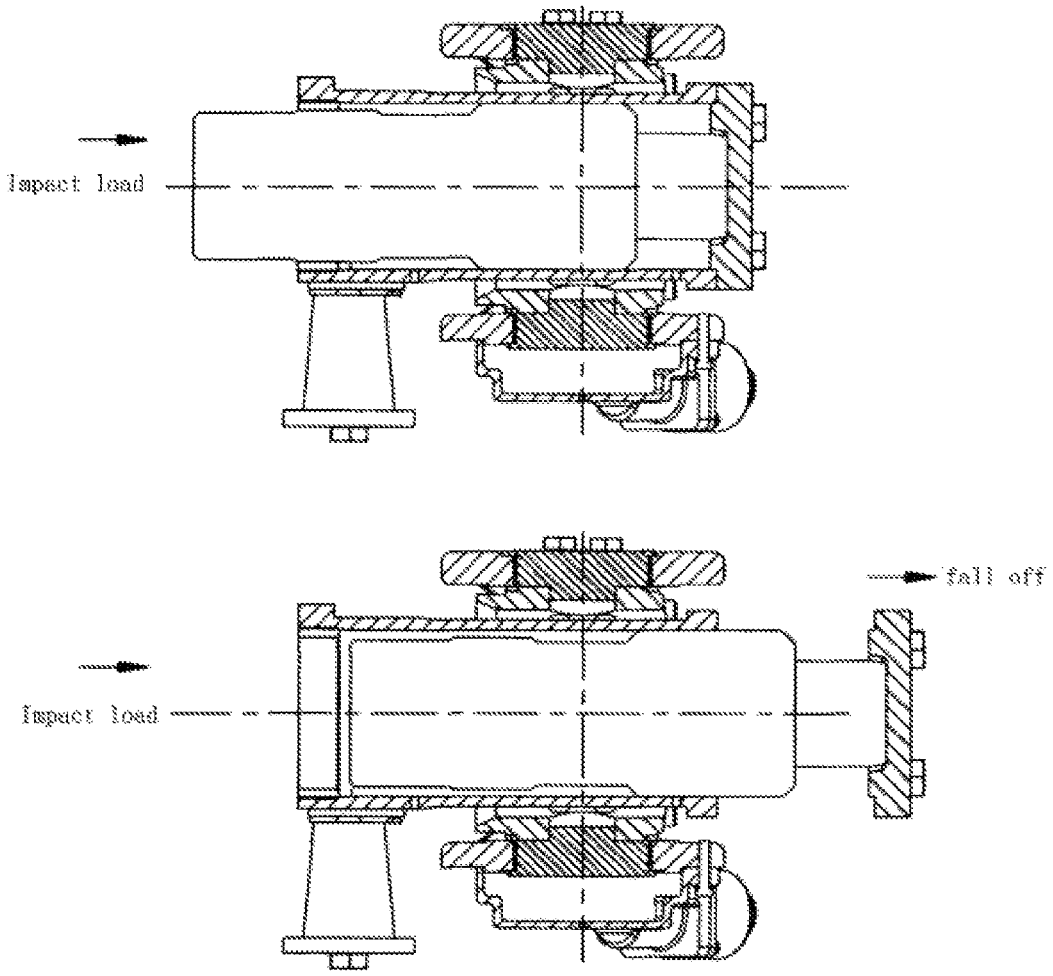
FIG. 4 is a schematic diagram of the invention under active state.
Figure 5:
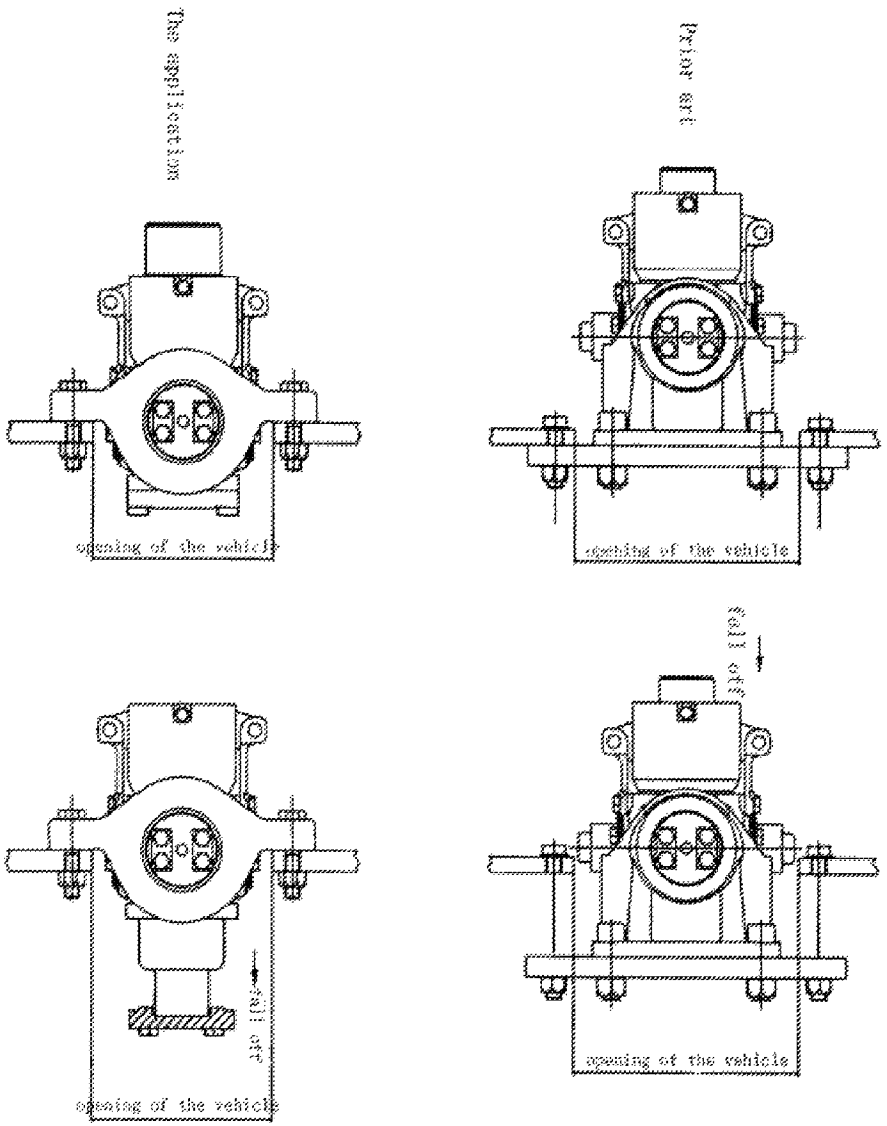
FIG. 5 is a comparison diagram between the invention and the prior art under active state.

Description of embodiments of the invention is made in combination with the accompanying drawings.

A compact buffer having overload protection, comprising a buffer connected to a coupling, a mount 1 connected to a vehicle body, and a rotating shaft 2 connecting the buffer to the mount 1; wherein the buffer comprises an elastic element 4, a buffer housing 3 accommodating the elastic element 4, and a protective cover 5 for bearing impact force located at the tail end of the buffer housing 3; the buffer housing and the protective cover 5 are connected by means of an overload protection device 6. The front end of the buffer housing is provided with a caging device. The caging device is a stop nut 7. The elastic element 4 is provided with a tensile and compressive converter plate 8 matched with the caging device.

When the device works, load is transmitted by a component at the front of the coupling to the elastic element 4, the elastic element 4 is restricted by the protective cover 5 and thus being compressed; when a compression load is beyond the design value for the overload protection device 6, the overload protection device 6 fails, and the connection between the protective cover 5 and the buffer housing 3 is broken; at this moment, the elastic element 4 inside and the component at the front enter into the buffer housing 3, and continue receding under the action of an impact load.

When a tractive force is applied to the vehicle body, the tractive force directly compresses the elastic element 4, and is transmitted to the stop nut 7, the buffer housing 3, the mount 1 and up to the vehicle body because the tensile and compressive converter plate 8 is limited by the stop nut 7; in this process, neither the protective cover 5 nor the overload protection device 6 is stressed.

What is claimed is:

1. A compact buffer having overload protection, comprising a connected to a coupling, a mount (1) connected to a vehicle body, and a rotating shaft (2) connecting the buffer to the mount (1); wherein the buffer comprises an elastic element (4), a buffer housing (3) accommodating the elastic element (4), and a protective cover (5) for bearing impact force located at the tail end of the buffer housing (3); the buffer housing and the protective cover (5) are connected by an overload protection device (6), wherein the overload protection device (6) connecting the buffer housing (3) and the protective cover (5) has a preset damage load, when a compression load is beyond the preset damage load, the overload protection device (6) will fail, and the connection between the protective cover (5) and the buffer housing (3) will be broken.

2. The compact buffer having overload protection according to claim 1, wherein the front end of the buffer housing is provided with a caging device.

3. The compact buffer having overload protection according to claim 2, wherein the caging device is a stop nut (7).

4. The compact buffer having overload protection according to claim 2, wherein the elastic element (4) is provided with a tensile and compressive converter plate (8) matched with the caging device.

5. The compact buffer having overload protection according to claim 3, wherein the elastic element (4) is provided with a tensile and compressive converter plate (8) matched with the caging device.

* * * * *